US007549814B1

(12) United States Patent
Arrington et al.

(10) Patent No.: US 7,549,814 B1
(45) Date of Patent: Jun. 23, 2009

(54) COMPACT LOW PAPER SENSOR MECHANISM

(75) Inventors: Stacy L. Arrington, Raleigh, NC (US); Richard H. Harris, Raleigh, NC (US); Dean F. Herring, Youngsville, NC (US); Robert A. Myers, Cary, NC (US); Robert D. Yoder, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/958,836

(22) Filed: Dec. 18, 2007

(51) Int. Cl.
*B41J 15/04* (2006.01)
*B65H 26/08* (2006.01)
*B65H 16/08* (2006.01)

(52) U.S. Cl. ..... 400/613; 242/595.1

(58) Field of Classification Search ..... None
See application file for complete search history.

(56) References Cited

U.S. PATENT DOCUMENTS

| | | | | |
|---|---|---|---|---|
| 2,581,711 | A * | 1/1952 | Roselius | 242/563.2 |
| 4,422,402 | A | 12/1983 | Ogihara | |
| 4,928,949 | A | 5/1990 | Ramsey et al. | |
| 5,174,518 | A * | 12/1992 | Hongo et al. | 242/422.5 |
| 5,279,472 | A * | 1/1994 | Hongo et al. | 242/422.5 |
| 5,629,672 | A | 5/1997 | Brown et al. | |
| 5,713,678 | A | 2/1998 | Smith et al. | |
| 6,135,384 | A | 10/2000 | Skelley et al. | |
| 6,536,696 | B2 | 3/2003 | Fiutak et al. | |
| 7,336,921 | B2 * | 2/2008 | Suzuki et al. | 399/407 |
| 2004/0118967 | A1 * | 6/2004 | Rengifo et al. | 242/588.6 |

FOREIGN PATENT DOCUMENTS

| | | | |
|---|---|---|---|
| EP | 1752304 | | 2/2007 |
| JP | 03089037 | U1 * | 9/1991 |
| JP | 08085650 | A * | 4/1996 |
| JP | 10029361 | | 2/1998 |

(Continued)

OTHER PUBLICATIONS

Research Disclosure Document No. 345074, Anonymous, "Sensing low paper supply in a point of sale printer," Jan. 1993.*
Machine translation of JP 08085650 to Murakami from Japanese Patent Office website, Apr. 1996.*

(Continued)

*Primary Examiner*—Daniel J Colilla
(74) *Attorney, Agent, or Firm*—Cantor Colburn LLP; Jason Piche

(57) ABSTRACT

A low paper sensor mechanism including first and second support rollers rotatable about a first and second rotational axis to support a paper supply roll, the first and second support rollers and rotational axes configured to translate in a path between a first position and a second position, first and second biasing members biasing the first and second support rollers toward the second position and a detection device, including a light emitting element and a light detecting element, disposed adjacent to the first and second support rollers, wherein the first and second support rollers move from the first position to the second position when a diameter of the paper supply roll is less than or equal to the predetermined distance between the first and second support rollers and the paper supply roll disrupts a line of sight between the light emitting element and the light detecting element.

3 Claims, 2 Drawing Sheets

FOREIGN PATENT DOCUMENTS

| | | | | |
|---|---|---|---|---|
| JP | 10167538 | A | * | 6/1998 |
| JP | 10172035 | A | * | 6/1998 |
| JP | 2001101454 | | | 4/2001 |
| JP | 2005350235 | | | 12/2005 |

OTHER PUBLICATIONS

Machine translation of JP 10167538 to Takifuji from Japanese Patent Office website, Jun. 1998.*
Translation of JP 03-89037 U; Mizoguchi, Tetsuo; Sep. 1991.*

* cited by examiner

COMPACT LOW PAPER SENSOR MECHANISM

BACKGROUND OF THE INVENTION

1. Field of the Invention

This invention relates generally to a sensor mechanism and, more particularly, to a compact low paper sensor mechanism.

2. Description of the Background

Presently, there are several different types of printers available. However, all printers share common components, such as a print head, a platen, a paper supply and a control mechanism. The control mechanism controls a motion of the print head relative to the paper supply, selects a character to be printed, and advances and retracts the paper supply, as necessary.

However, regardless of the type of printer used, it is generally undesirable to operate a printer without paper. For example, ink-based printers that are operated without paper will transfer ink into the platen, which may, in turn, stain a back side of subsequent sheets of paper and may also damage print writes within the print head.

Also, thermal printers that are operated without paper may overheat, since the paper is also used to absorb heat generated by the print head during printing operations. In addition, operating thermal printers without paper may cause excessive wear to the print head, since the print head would be running directly on the platen, instead of on the paper.

Therefore, in order to avoid operating the printers without paper, conventional printers have been provided with low-paper sensing and warning systems. Moreover, low-paper sensing has recently become an important requirement, as retailers move towards system management, which requires system notification that a paper supply is near completion.

However, previously developed low-paper sensors have poor accuracy. That is, since these low-paper sensors typically consist of a lever that rubs on one side edge of a paper supply roll, the lever either drops over the top of the paper supply roll or into a core of the paper supply roll due to a movement (e.g., bouncing or jumping) of the paper supply roll during an operation of the printer; thereby causing the lever to erroneously trip a switch to indicate that the paper supply is low.

Therefore, in order to address the poor accuracy of these low-paper sensors, printers have been provided with a sensing mechanism that includes an optical sensor and two support rollers, which support a paper supply roll. The two support rollers are spaced apart from each other at a predetermined distance, so that when a diameter of the paper supply roll becomes less than the predetermined distance, the paper supply roll drops between the two rollers and is then detected by the optical sensor. However, printers with such a sensing mechanism require an additional amount of space in order to accommodate for the paper supply roll which is allowed to drop between the two rollers, which, in turn, increases a size and a manufacturing cost of the printer.

Thus, what is needed is a sensor mechanism capable of accurately detecting a low paper condition while minimizing a required space within a printer.

SUMMARY OF THE INVENTION

The shortcomings of the prior art are overcome and additional advantages are provided by a low paper sensor mechanism for a printer including first and second support rollers rotatable about a first and second rotational axis, respectively, and attached within the printer to support a paper supply roll, the first and second support rollers spaced apart from each other at a predetermined distance, the first and second support rollers and rotational axes configured to translate in a path between a first position and a second position, first and second biasing members corresponding to the first and second support rollers, respectively, the first and second biasing members biasing the first and second support rollers toward the second position, the path between the first and second positions being collinear with a translational axis of the first and second biasing members, respectively and a detection device, including a light emitting element and a light detecting element, disposed adjacent to the first and second support rollers, the light emitting element being disposed in a line of sight of the light detecting element, wherein the first and second support rollers move from the first position to the second position when a diameter of the paper supply roll is less than or equal to the predetermined distance between the first and second support rollers and the paper supply roll disrupts the line of sight between the light emitting element and the light detecting element.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF SPECIFIC EMBODIMENTS

The present invention will be described with respect to a point-of-sale ("POS") printer having a paper supply roll. However, the present invention is also applicable to other devices including any other type of material disposed on a roll, wherein a dimension (e.g., a diameter) of the material supply roll decreases during an operation of the device.

Figure 1:
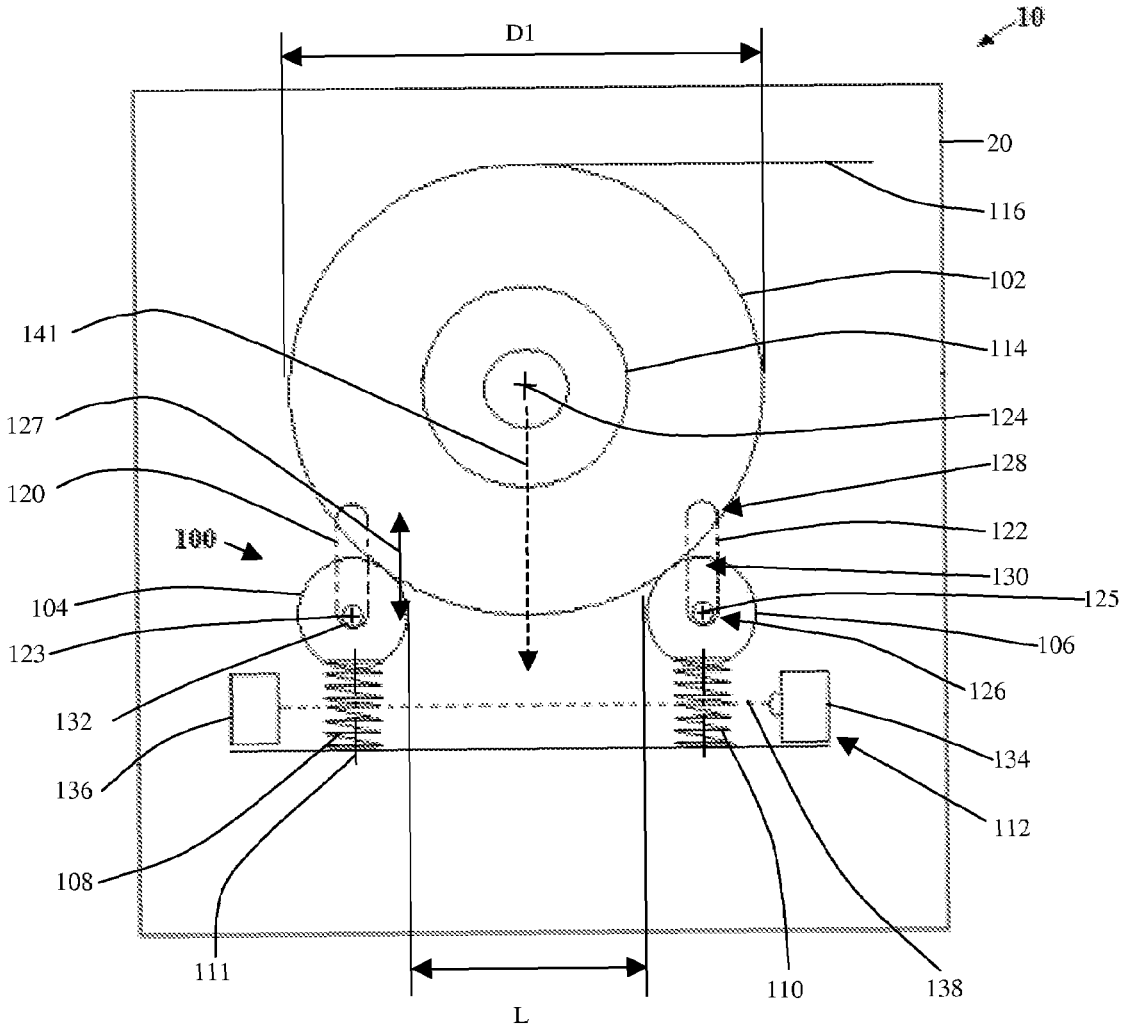
FIG. 1 is a schematic diagram illustrating a side view of a printer having an exemplary embodiment of compact low paper sensor mechanism in accordance with the present invention, wherein support rollers are in a compressed state.
Figure 2:
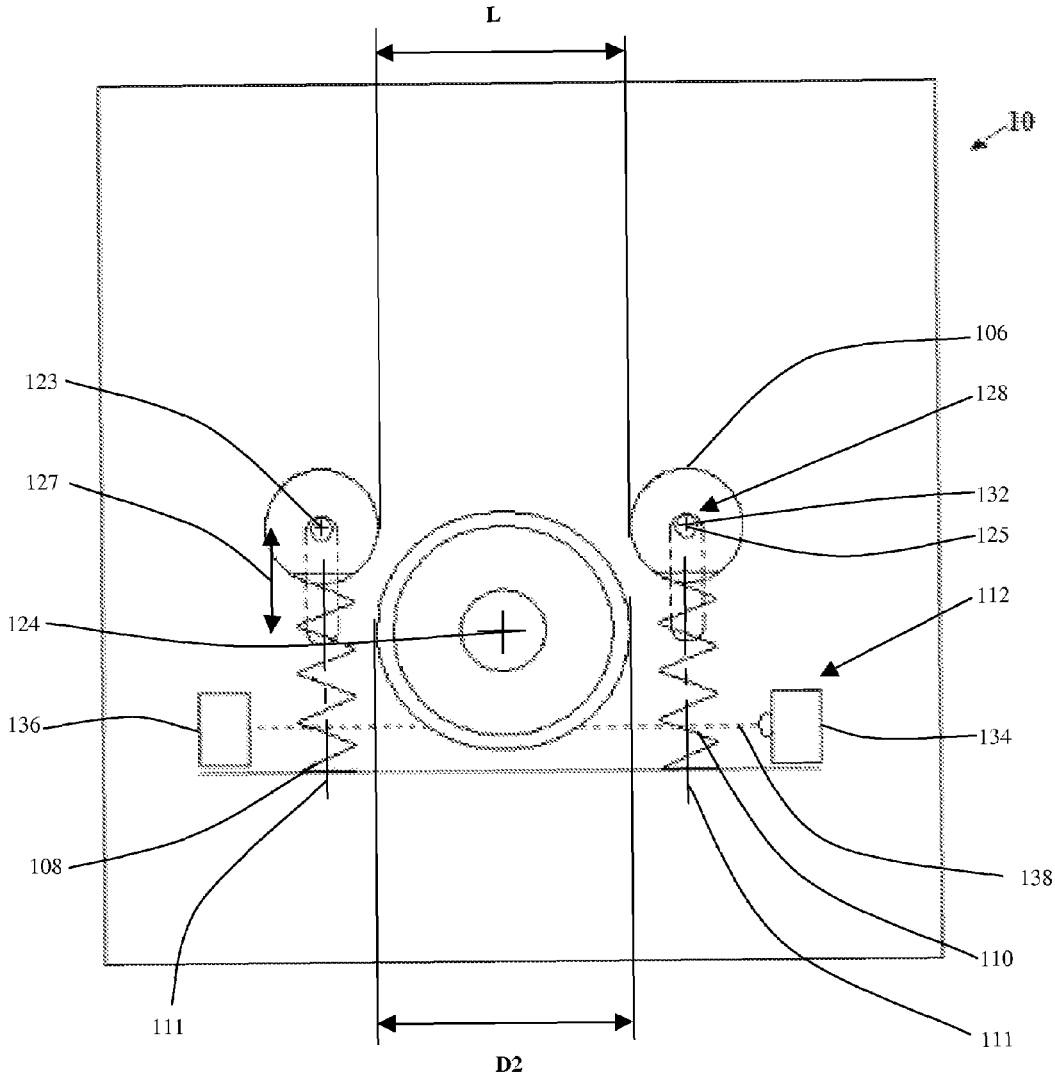
FIG. 2 is a schematic diagram illustrating a side view of a printer having the exemplary embodiment of compact low paper sensor mechanism in accordance with the present invention, wherein the support rollers are in an expanded state.

FIG. 1 is a schematic diagram illustrating a side view of a printer 10 having an exemplary embodiment of compact low paper sensor mechanism 100 in accordance with the present invention, wherein first and second support rollers 104 and 106 are in a compressed state. FIG. 2 is a schematic diagram illustrating a side view of a printer 10 having an exemplary embodiment of compact low paper sensor mechanism 100 in accordance with the present invention, wherein the first and second support rollers 104 and 106 are in an expanded state.

Referring to FIG. 1 illustrating a side view of the printer 10 in which a compact low-paper sensor mechanism 100 of the present invention is mounted, the printer 10 includes a housing 20, a paper supply roll 102, first and second support rollers 104 and 106, first and second biasing members 108 and 110 and a detection device 112.

As illustrated in FIG. 1, the paper supply roll 102, including a core member 114 and a length of a paper sheet 116 wrapped around the core member 114, has a first diameter D1. However, during an operation of the printer 10, the first diameter D1 is configured to decrease to a second diameter D2 (FIG. 2) due to a decrease in the length of the paper sheet 116 wrapped around the core member 114. In the current exemplary embodiment, the first diameter D1 defines a condition wherein the paper supply roll 102 is full, and the second diameter D2 defines a condition wherein the paper supply roll 102 is near completion or empty. However, the present invention is not limited thereto.

In exemplary embodiments, the first and second support rollers 104 and 106 are rotatably mounted within the housing 20 adjacent to and in contact with a surface of the paper supply roll 102. The first and second support rollers 104 and 106 are rotatable about a first and second rotational axes 123 and 125, respectively. That is, the first and second support rollers 104 and 106 are configured such that the paper supply roll 102 is capable of freely rotating in order to feed the paper sheet 116 from the paper supply roll 102. As illustrated in FIGS. 1 and 2, in exemplary embodiments, the first and second support rollers 104 and 106 are spaced apart from each other at a predetermined distance L. In the current exemplary embodiment, the predetermined distance L is less than the first diameter D1 of the paper supply roll 102. In further exemplary embodiments, the first and second support rollers 104 and 106 may be used in order to reduce a frictional loading which retards a rotation of the paper supply roll 102.

In exemplary embodiments, the housing 20 further includes first and second support roller guide members 120 and 122, which guide a movement of the first and second support rollers 104 and 106, respectively. That is, in exemplary embodiments, the first and second support roller guide members 120 and 122 include a slot which defines a path in which the first and second rotational axes 123 and 125 of the first and second support rollers 104 and 106, respectively, are allowed to travel. In further exemplary embodiments, the first and second support roller guide members 120 and 122 extend substantially in parallel with each other. As illustrated in FIG. 1, the first and second support guide members 120 and 122 include a first end 126, a second end 128 and a cavity 130 disposed between the first and second ends 126 and 128. In exemplary embodiments, the first end 126 corresponds a first position of the first and second support rollers 104 and 106, and the second end 128 corresponds a second position of the first and second support rollers 104 and 106. That is, the first and second support rollers 104 and 106 and the first and second rotational axes 123 and 125 are configured to translate in a path 127 between the first position (FIG. 1) and the second position (FIG. 2).

In exemplary embodiments, the first and second support rollers 104 and 106 include support members 132 which are disposed on opposite ends of the first and second support rollers 104 and 106. That is, in exemplary embodiments, the support members 132 are configured to travel within the cavity 130 defined by the first and second support guide members 120 and 122.

In exemplary embodiments, the compact low-paper sensor mechanism 100 further includes first and second biasing members 108 and 110 which correspond to the first and second support rollers 104 and 106, respectively. The first and second biasing members 108 and 110 provide a force onto the first and second support rollers 104 and 106 along a translational axis 111, such that the first and second support rollers 104 and 106 are biased toward the second position. In exemplary embodiments, the path 127 between the first and second position is collinear with the translational axis 111 of the first and second biasing members 108 and 110, respectively.

In exemplary embodiments, the paper supply roll 102 is held in place by gravity, such that the surface of the paper supply roll 102 is maintained in contact with the first and second support rollers 104 and 106 while the paper sheet 116 is drawn from the paper supply roll 102.

As illustrated in FIG. 1, when the paper supply roll 102 has the first diameter D1, gravity and a mass of the paper supply roll 102 create a force which is larger than the force provided by the first and second biasing members 108 and 110, which thereby compresses the first and second support rollers 104 and 106 in a compressed state (e.g., the first position). That is, the support members 132 of the first and second support rollers 104 and 106 are disposed adjacent to the first end 126 of the support roller guide members 120 and 122 when the first and second support rollers 104 and 106 are in the compressed state.

However, during an operation of the printer 10, a diameter (e.g., the first diameter D1) of the paper supply roll 102 reduces to a different diameter (e.g., the second diameter D2), since the paper sheets 116 are removed from the paper supply roll 102. The mass of the paper supply roll 102 is thereby reduced, which, in turn, reduces the force created by gravity and the paper supply roll 102. Therefore, as illustrated in FIG. 2, when the force provided the first and second biasing members 108 and 110 is greater than the force created by gravity and the paper supply roll 102, the first and second support rollers 104 and 106 move toward the second end 128 (e.g., the second position) of the first and second support guide members 120 and 122, which defines an expanded state.

Referring now to FIGS. 1 and 2, in exemplary embodiments, the detection device 112 includes a light emitting element 134 and a light-receiving element 136. The light emitting element 134 and the light-receiving element 136 are disposed in a line-of sight 138 of each other, such that an optical beam, for example, may be emitted from the light emitting element 134 and received by the light receiving element 136.

In the current exemplary embodiment, the detection device 112 is disposed within the housing 20, such that when the diameter of paper supply roll 102 (e.g., the second diameter D2) is less than or equal to the predetermined distance L between the first and second support rollers 104 and 106, the paper supply roll 102 drops between the first and second support rollers 104 and 106 in a direction opposite to a direction defined by the first and second support rollers 104 and 106 moving toward the second end 128 (e.g., the second position) of the first and second support guide members 120 and 122 from the first position, to thereby disrupt the line-of-sight 138 of the detection device 112. That is, the paper supply roll 102 translates along an axis that corresponds to direction arrow 141 in phantom and is parallel to axis 111, as depicted in FIG. 1. In exemplary embodiments, the disruption of the line-of-sight 138 of the detection device 112 indicates a low paper condition.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A low paper sensor mechanism for a printer comprising:

a housing, including first and second faces and sidewalls formed to support the first and second faces in opposition to one another, and having pairs of corresponding guide members defined in each of the first and second faces;

first and second support rollers, rotatable about a first and second rotational axis, respectively, being supported within the housing by the guide members to support a portion of a paper supply roll from which a supply of paper is dispensed horizontally from the top of the paper roll until a diameter of the paper supply roll is less than a distance between the first and second support rollers, the first and second support rollers being further configured to move from first to second positions of the guide members during an entire time the paper supply roll is expended and a diameter of the paper supply roll decreases, the second positions being closer to the portion of the supply of the paper being dispensed;

first and second biasing members, coupled to the housing, to expansively bias the first and second support rollers toward the second position in opposition to a force of a mass of the paper supply roll; and a detection device, including a light emitting element and a light detecting element, disposed adjacent to the first and second support rollers within the housing, the light emitting element being disposed in a line of sight of the light detecting element, wherein:

a current rate of the movement of the first and second support rollers is directly proportional to the corresponding current diameter of the paper supply roll, and, when the first and second support rollers reach the second position and once the diameter of the paper supply roll decreases sufficiently such that the diameter of the paper supply roll is less than the distance between the first and second support rollers, the paper supply roll drops toward the detection device and disrupts the line of sight between the light emitting element and the light detecting element.

2. The low paper sensor mechanism of claim 1, wherein the distance is less than a diameter of the paper supply roll in a low paper condition.

3. The low paper sensor mechanism of claim 1, wherein the disruption of the line of sight between the light emitting element and the light detecting element indicates a low paper condition.

* * * * *